United States Patent [19]

Horton

[11] 4,365,551

[45] Dec. 28, 1982

[54] SCREEN PRINTING APPARATUS

[75] Inventor: David Horton, Ashford, England

[73] Assignee: Letraset Limited, London, England

[21] Appl. No.: 177,492

[22] Filed: Aug. 12, 1980

[51] Int. Cl.[3] ..... B05C 17/04; B41L 27/00

[52] U.S. Cl. ..... 101/124; 101/126

[58] Field of Search ..... 101/124, 126

[56] References Cited

U.S. PATENT DOCUMENTS 2,870,703 1/1959 Balmer ..... 101/126

4,245,554 1/1981 Kammann ..... 101/124

*Primary Examiner*—A. J. Heinz

*Attorney, Agent, or Firm*—Darby & Darby

[57] ABSTRACT

The invention relates to screen printing apparatus which comprises a printing station, means for feeding a web of material to be printed to the printing station and away therefrom, a squeegee mounted at the printing station for cooperation with a screen printing mesh, means for attaching a screen printing mesh tensioned on a frame so that part of the mesh is at the printing station, means for reciprocating such a screen printing mesh in a frame through the printing station, means for feeding ink to one side of the squeegee, a profiled support at the printing station for supporting the material to be printed, and means for advancing the screen mesh in a frame and the material to be printed at the same speed past the printing station while biasing the screen mesh by means of the squeegee towards the support. According to the invention the profiled support is movable in order to compensate for changes in the shape of the screen mesh during the printing stroke. Furthermore, improved quality is obtained by means of a clamping bar system for advancing the material to be printed past the printing station.

4 Claims, 3 Drawing Figures

SCREEN PRINTING APPARATUS

GENERAL FIELD OF THE INVENTION

This invention relates to screen printing apparatus.

BACKGROUND OF THE INVENTION

Screen printing apparatus has been known for very many years. In recent years a wide variety of screen printing machines has been developed for reducing the high labour content of screen printing associated with so-called hand-bench operation. Screen printing using a hand-bench is also a highly skilled operation and for long production runs this is also uneconomic.

Screen printing apparatus for printing materials is described inter alia in British patent specification Nos. 1,200,481; 821,090; 395,900; 316,467 and 180,869, German Auslegeschrift No. 1038067 and British patent specification Nos. 1,367,441 and 1,549,748.

Screen printing has classically been used for printing jobs where solid colours were required such as for posters and placards and it has found particular application in fields where relatively low print definition is required. It requires considerable skill to print more than one image satisfactorily in register by silk screen printing due to the inherent deformability of the silk screen itself.

In recent years, however, screen printing has been adopted as the printing method of choice in the manufacture of dry transfer lettering and symbol sheets for use in the graphic arts and other fields. In this application it is of substantial importance that each of the letters on each sheet of dry transfer material be accurately printed with high edge definition and no distortion. Automatic screen printing machines designed or adapted to print such dry transfer lettering and symbol sheets up till now have fulfilled these requirements only to a limited degree.

It is an object of the present invention to provide a screen printing machine which overcomes certain of the disadvantages of the prior art. It is a further object of the invention to provide a screen printing machine which is particularly adapted for high quality screen printing such as is required, for example, in the manufacture of dry transfer lettering and symbol sheets.

GENERAL DESCRIPTION OF THE INVENTION

We have found that a substantial improvement in print quality may be obtained by close attention to the way in which the material to be printed is fed through the printing station. Thus, in a first aspect of the present invention a screen printing apparatus is provided including a printing station and means to feed a web of material to be printed towards and away from the printing station, screen and squeegee means being arranged to cooperate at the printing station to impress on the material to be printed an image by the screen printing process, wherein the means for moving the material to be printed through the printing station comprises a pair of clamping bars, means for reciprocating the pair of clamping bars to and fro along an elongate path in a forward stroke and a return stroke, means for biasing the clamping bars towards one another during the forward stroke to grasp a web of material to be printed therebetween and means for moving the clamping bars apart during the return stroke.

Such a web transport system is mounted downstream of the printing station and serves to pull the material to be printed through the printing station with great evenness and precision. The means for moving the clamping bars to and fro may be positively linked to the means in the printing machine for reciprocating the screen and raising and lowering the squeegee.

In another aspect, attention is paid to the fact that the shape of the screen printing mesh at the beginning of the print stroke is different from the shape of the mesh at the end of the print stroke. When the squeegee is pressed down towards the mesh, it naturally distorts the mesh away from a flat surface on the underside of the screen frame to a pair of substantially flat sections at a very slight angle to one another meeting in a ridge where the squeegee is. The so-called snap-on and snap-off angles i.e the angle at which the screen mesh and material to be printed meet and are parted, thus changes from the beginning of the print stroke to the end of the print stroke. We have now found that if this change is compensated by shifting the base on which the material to be printed is supported during the print stroke, then much better results may be achieved. Thus, in a further aspect the present invention provides screen printing apparatus for printing a web of material at a printing station including a support mounted at the printing station for supporting the material to be printed, and means for moving the support during the print stroke to maintain a substantially constant angle between the support surface, and hence the web of material to be printed which lies against the support surface on the one hand, and the screen printing mesh on the other hand.

These two aspects of the invention may be advantageously combined in a single screen printing machine which is capable of printing a web e.g. of a plastics film with high quality distortion-free images at high production rates.

Such a machine can of course be constructed in many ways but a particularly elegant way of constructing the machine in order to achieve the constant snap-on and snap-off angles throughout the screen printing stroke is to mount the support member rotatably about an axis at or near the line of contact between the squeegee and the mesh and to provide, on a frame or carriage for the receipt of a screen frame having a screen printing mesh tensioned across it, a cam which is followed during the printing stroke by a follower mounted on a support member. By using an appropriate cam, the snap-off angle may be maintained constant throughout the printing stroke.

Preferably also the web guidance means includes two eccentrically mounted bars, one upstream and one downstream of the printing station, the upstream bar being adjustable to alter the angle at which material to be printed is fed to the printing station and the downstream bar being adjustable to alter the angle at which printed material leaves the printed station. In use, the web slides over the eccentrically mounted bars on either side of the support which is preferably a freely rotatable roller. By rotation of the bars about their eccentric mountings, the web as it passes over the bars is raised or lowered, thus altering the angles at which the web enters or leaves the printing station. These angles can thus be adjusted to the optimum to give the best print quality.

Static elimination bars, e.g. of the radioactive air ionizing type, may be employed to dissipate static electric charge at the screen mesh, web and squeegee interface. Static charge has a tendency to build up especially when polyester material, which can generate a high static charge prior to or during printing, is used. Such a static charge can cause print faults due to "whiskering" or "ink fly" around the edge of printed characters at high press speeds but the faults may be greatly reduced if the charge is dissipated.

In many printing presses the provision of static eliminator bars is very inconvenient or indeed impossible simply because there is insufficient room available at the printing station. However according to the present invention static eliminator bars may conveniently be provided on either side of the printing station between the eccentrically mounted bars. More particularly the static eliminator bars may be supported by being recessed in the eccentrically mounted bars though of course they must not at the same time affect the angle adjustment facility of the eccentrically mounted bars. In this way the static eliminators may be provided in close proximity to the screen mesh, web and squeegee interface to reduce static charge while not impeding the apparatus.

DETAILED DESCRIPTION WITH REFERENCE TO THE ACCOMPANYING DRAWINGS

Further features of the invention will become apparent from the following exemplary description of an apparatus constructed in accordance with the invention. This description should be read in conjunction with the accompanying drawings in which.

Figure 1:
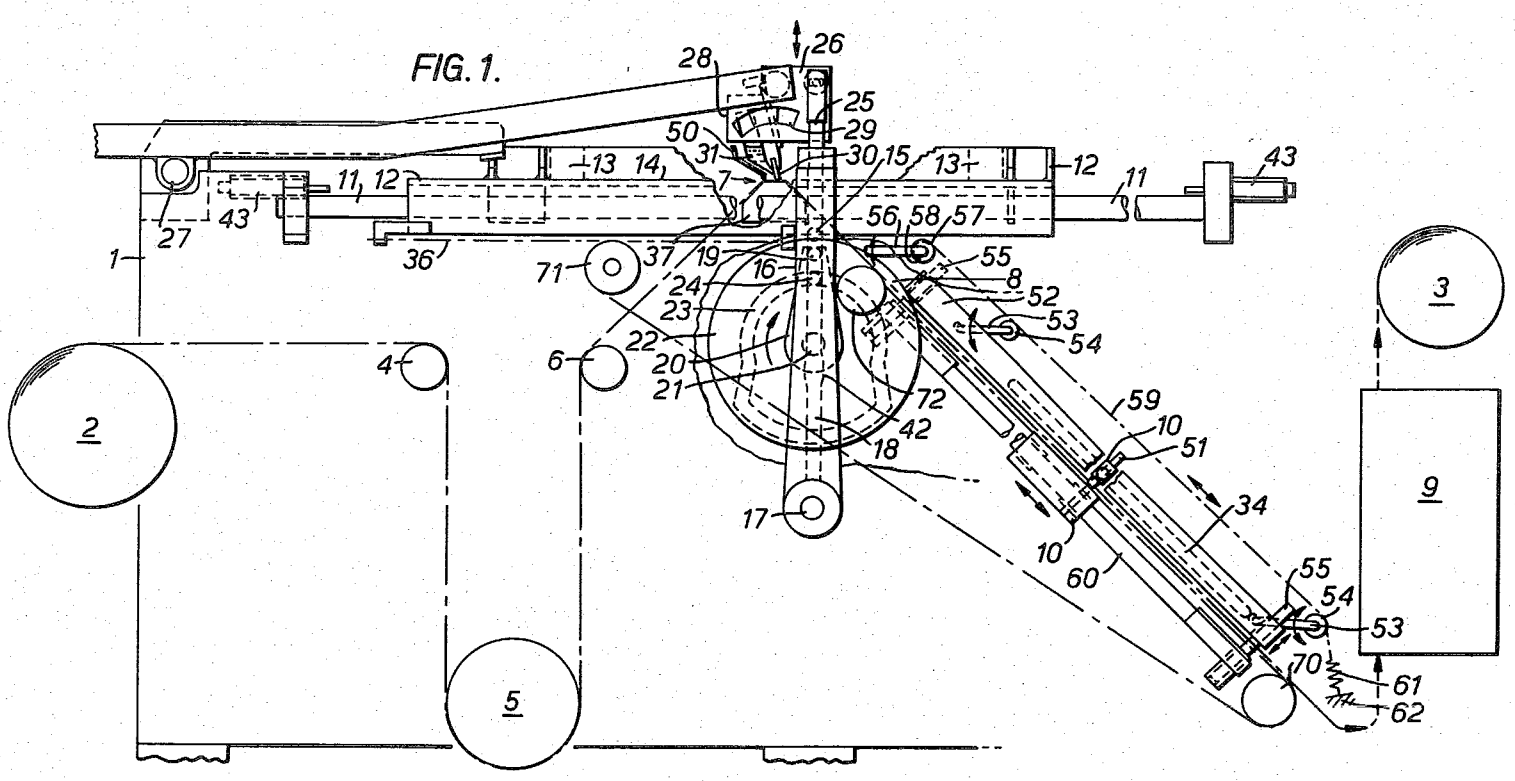
FIG. 1 is a diagrammatic side view of screen printing apparatus in accordance with the invention.

Referring first of all to FIG. 1 the apparatus comprises a frame 1 on which the various parts of the apparatus are supported. A roll 2 of material to be printed is supported at one end of the machine while at the other end of the machine a take up roll 3 is provided for receiving the printed web material. From the roll 2, the web of material to be printed passes over a guide roller 4, around a vertically freely movable tensioning roller 5, over a further guide roller 6, through a printing station indicated generally at 7, down a rectilinear path 8 defined by various guide rollers and into a drying chamber 9 of known type through which it is guided by various rollers and from which it emerges on to take-up roll 3.

Take-up roll 3 is driven via a friction clutch so as to maintain the web of material under slight tension. The pull exerted by take-up roll 3 is however insufficient to pull the web through the machine from roll 2. Instead, movement from roll 2 through the machine is accomplished by a pair of clamping bars 10 which may be moved towards one another to clamp the web between them or away from one another to release the web and which may additionally be moved to and fro adjacent path 8. The movement of the clamping bars 10 is described in more detail below.

Along the upper side of the apparatus is a track 11 formed by a pair of rails on which a carriage 12 runs. Carriage 12 is adapted to receive a screen printing frame 13 having a screen printing mesh 14 tensioned across the frame 13. Carriage 12 is connected via a linking piece 15, one on each side of carriage 12, to actuation arms 16 which are pivoted at 17 to the frame 1.

The facing surfaces of the two actuation arms 16 each bear a longitudinal groove 18 in which a pin 19 slides. Pin 19 is on the end of a crank arm 20 which is attached to a drive shaft 21. When the apparatus is in use, shaft 21 is rotated at constant speed. As crank arm 20 rotates, it accordingly causes actuation arm 16 to oscillate, the motion thereby imparted to the carriage 12 being faster as carriage 12 moves to the right as seen in FIG. 1 than the speed of carriage 12 when it is moving towards the left as seen in FIG. 1. As seen in FIG. 1, drive shaft 21 is rotated clockwise. Movement of carriage 12 to the right as seen in FIG. 1 corresponds to a printing stroke while movement of carriage 12 towards the left corresponds to a return stroke. It will be appreciated that the drive mechanism not only leads to a relatively slow substantially constant speed printing stroke and a fast return stroke, but also that at each end of the printing stroke there is a short part of the cycle during which the carriage is essentially stationary. This period enables vibration and judder to be avoided at the commencement and termination of each printing stroke which further enhances the print quality obtainable. This is achieved by the provision of a slightly widened section 42 of the groove 18, so positioned that pin 19 on the end of crank arm 20 is not firmly engaged at the end of the forward and return strokes on carriage 12. This provides a short period dwell at the ends of the forward and return strokes of the carriage which further assists in giving an overall smooth running to the device.

In order further to smooth out the motion of the carriage 12, hydraulic shock absorbers 43 are provided at each end of track 11 and so positioned that at the end of the stroke carriage 12 is smoothly brought to rest by the shock absorbers. The shock absorbers are preferably adjustable in order to enable them to be adjusted to compensate in optimum fashion for the weight of the carriage which may vary e.g. if the weight of the frame 13 set therein varies.

Also mounted on drive shaft 21 are a pair of main cams 22 each having a track 23 in which a cam follower 24 engages. As can be seen from a consideration of the shape of track 23, follower 24, which is movable only vertically as seen in FIG. 1, is caused to move up and down, its downward position corresponding to the print stroke of the apparatus and its upward position corresponding to the return stroke. Follower 24 is connected to a push rod 25 which is pivoted to a squeegee support frame 26 at its upper end. The squeegee support frame 26 is in turn hinged to the frame 1 of the apparatus at 27.

The squeegee support frame 26 comprises a pair of mounting plates 28 each of which has an arcuate slot 29 therein. The center of the arc of slot 29 corresponds to the edge of a squeegee blade 30 which comes into contact with the screen mesh 14 when the blade is correctly installed. Squeegee blade 30 is installed by means of threaded studs passing through arcuate slots 29 and locking nuts which engage the outer faces of plates 28. It will be seen that varying the positions of the mounting studs and nuts in slot 29 rotates the squeegee blade 30 about its point of contact with the mesh 14.

The left hand side of squeegee blade 30 as seen in FIG. 1 bears an ink reservoir 31 in the form of a tank extending across the squeegee blade and having a lower floor 32 which terminates closely adjacent but not touching a rubber insert 33 (refer to FIG. 2) which constitutes the operative part of squeegee blade 30. Ink may thus emerge through the slot between floor 32 and insert 33 to form a bead of ink behind the squeegee blade as mesh 14 is moved to the right as shown in FIG. 1 during a printing stroke.

The apparatus shown in FIG. 1 has a fixed position floodbar 50, located to the left of the squeegee blade 30 as seen in FIG. 1. During a printing stroke, the squeegee 30 presses mesh 14 downwards, into contact with the material to be printed and out of contact with the floodbar. When blade 30 is raised at the end of the print stroke (by pushrod 25) the mesh 14 springs back and comes into gentle contact with the lower edge of floodbar 50. During the return stroke, as mesh 14 moves to the left as seen in FIG. 1, the bead of ink behind the squeegee blade 30, left on the mesh when blade 30 is raised, is spread evenly over the mesh surface by floodbar 50, and is then ready for the next printing stroke. The provision of a fixed floodbar materially reduces the problems of floodbar adjustment and timing encountered on known types of screen printing machines which have a movable floodbar and means for moving it into and out of contact with the mesh in time with the printing strokes.

The movement of the web of material to be printed through the print station is achieved by means of clamping bars 10. The upper clamping bar is slidably mounted on posts 51 set on the lower clamping bar. The lower clamping bar slides on a track 60 formed of a pair of hardened steel shafts. The upper clamping bar slides in a pair of tracks 34 in a pair of guide bars 52, one each side of the machine. Guide bars 52 can move toward and away from track 60 on posts 55, and this movement is effected by rotation of two crank arms 53 which are rotatably mounted on the machine frame. Fixed to each crank arm 53 is a sprocket 54. A further crank arm 56 is rotatably mounted on the machine frame with its end pivoted to pushrod 25 by a pivotal connection not illustrated for the sake of simplicity. Fixed to crank arm 56 is a sprocket 57. Fixed to sprocket 57 at 58 is a chain 59 which engages sprockets 54 and whose end is held via a tension spring 61 to the machine frame at 62.

During a print stroke, pushrod 25 is down, cranks 53 and 56 rotated anticlockwise (as seen in FIG. 1) to their end position, so track 34 is nearer track 60 and clamping bars 10 clamped together. During the return stroke, pushrod 25 is up, cranks 53 and 56 are at their clockwise end position, track 34 is more remote from track 60 and clamping bars 10 are out of contact and not gripping the printed material.

As well as moving relative to one another in this way, clamping bars 10 are moved up and down as a unit in time with the movement of carriage 12. This is effected simply by a chain connection 36. The chain runs from one end of the lower clamping bar 10 round an idler sprocket 70, a drive sprocket 71 and an idler sprocket 72 to the other end of lower clamping bar 10. Sprocket 71 is positively driven by a pinion wheel fixed on the same shaft which pinion wheel meshes with a rack on the underside of carriage 12. Two such linkage arrangements are provided, one on each side of the apparatus.

The positioning of the tracks 60 and 34 and of clamping bars 10 is naturally arranged so that they clamp the printed material at the unprinted areas between each pair of adjacent printed areas.

Directly below the squeegee blade 30 is a support surface 37. This support surface may be mounted in frame 1 in releasable fashion to enable alternative shaped support surfaces 37 to be installed where desired for particular printing work. Two different shapes are shown in FIGS. 1 and 2.

Figure 2:
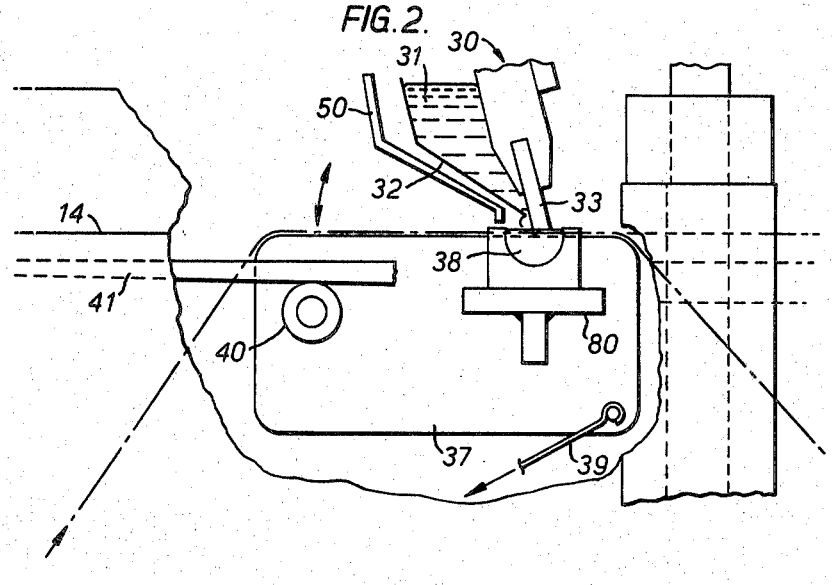
FIG. 2 is a sectional view on an enlarged scale showing an embodiment of printing station.

With reference to FIG. 2 of the accompanying drawings, the support surface 37 is mounted for rotation about a point 38 by suitable pivot pins supported by pivot support 80 fixed to the frame 1 of the press. A tension spring 39 biases the support surface 37 for clockwise movement i.e. the left hand end of support surface 37 as seen in FIG. 2 tends to lift. This lifting is prevented by a cam follower roll 40 which abuts a bar 41 fixed to the side of carriage 12. The lower surface of bar 41 is closer to the surface of the mesh 14 at the left hand end of carriage 12 than at the right hand end. Thus as carriage 12 is advanced to the right during the printing stroke, the cam follower roll 40 rises and the whole of support surface 37 is rotated clockwise about point 38. Thus the snap off angle between the mesh 14 to the right of the squeegee blade 30 and the material on which printing is taking place is held substantially constant throughout the travel of carriage 12 instead of diminishing towards the end of the print stroke. Likewise, the angle at which mesh and material to be printed meet remains constant.

Care must of course be taken to ensure that the tension in the web to the left hand side of support surface 37 is not so great as to cause cam follower roll 40 to move away from the lower surface of bar 41. It is found that this arrangement as shown in FIG. 2 in which the support surface tilts as the print stroke is carried out leads to a substantial improvement in print definition towards the end of the printing stroke.

Figure 3:
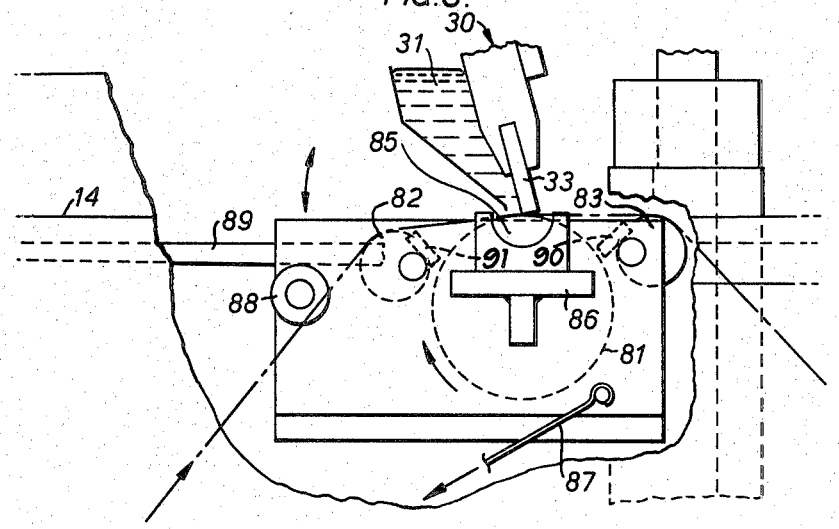
FIG. 3 is a sectional view on an enlarged scale showing an alternative embodiment of printing station.

A preferred embodiment of the printing station is shown in section in FIG. 3. In this embodiment, support for the web at the printing station is provided by a freely rotatable print roller 81, which may be perforated and provided with a vacuum source or may be without a vacuum source. Upstream of roller 81 is an eccentrically mounted bar 82 and downstream of the roller is a second eccentrically mounted bar 83. The web slides over eccentrically mounted bar 82 before entering the printing station and over bar 83 after leaving the printing station. By altering the rotation of the bars 82 and 83, the web may be raised or lowered as it passes over the respective bar. Thus the angle at which the web and screen mesh meet and that at which the web and screen mesh depart at the printing station can be adjusted to the optimum to give the best print quality.

The roller 81 and bars 82 and 83 are mounted between sideplates and as a unit can be tilted during the print stroke to maintain the optimum angles in a similar manner to the support of the embodiment of FIG. 2. Thus the unit is mounted for rotation about a point 85, support being provided by a pivot support 86 fixed to the frame 1 of the press. A tension spring 87 biases the unit for clockwise movement as seen in FIG. 3. This lifting is prevented by a cam follower roll 88 which abuts a bar 89 fixed to the side of carriage 12. The lower surface of bar 89 is closer to the surface of the mesh 14 at the left hand end of carriage 12 than at the right hand end. Thus as carriage 12 is advanced to the right during the printing stroke, the cam follower roll 88 rises and the unit is rotated clockwise about point 85.

In addition there are provided, one on either side of roller 81, a pair of static eliminator bars 90 and 91. The static eliminator bars are supported in recesses in the eccentrically mounted bars 82 and 83 in such a way that they do not affect the optimum angle adjustment between the web and mesh. The static eliminator bars 90 and 91, which may for example be of the radioactive air ionizing type, help to dissipate static electric charge which has a tendency to build up at the screen mesh, web and squeegee interface before and during printing, especially when e.g. a polyester material is employed. In this way print faults due to "whiskering" or "ink fly" around the edge of printed characters which may be encountered at high press speeds with polyester materials may be greatly reduced.

I claim:

1. In screen printing apparatus for printing on web material, a printing station including:

a screen printing mesh attached under tension to a screen frame;

reciprocating means for rectilinearly reciprocating said screen frame with a particular speed;

a squeegee mounted above said screen printing mesh for movement into contact with said screen printing mesh along a line of contact, and out of contact with said screen printing mesh;

means for feeding ink to one side of the squeegee above the mesh;

a profiled support surface positioned opposite said squeegee and below said screen printing mesh for supporting a portion of the web material in a planar configuration which forms a snap-off angle between itself and the screen printing mesh at the line of contact, said screen printing mesh being biased toward said support surface when said squeegee is in contact with it;

conveyor means for moving the web of material to be printed on between said support surface and said screen printing mesh at the location of said squeegee, said conveyor means moving said web of material at the particular speed of said reciprocating means during a printing stroke when said screen printing mesh is biased towards said support surface by said squeegee, the improvement comprising;

means for moving said support surface during said printing stroke to change the position of the planar configured portion of the web such that the snap-off angle between the support surface, and hence the portion of the web of material which lies against the support surface, and the portions of the screen printing mesh after the squeegee, is maintained at a substantially constant value, a snap-on angle between the support surface and the portion of the web of material before the squeegee also is maintained at a substantially constant value.

2. The apparatus of claim 1 further including:

means for mounting said support surface for pivotal movement about a pivot axis located in the vicinity of the line of contact between the squeegee and the mesh;

a cam follower fixed with respect to the support; and a cam surface disposed along the path of the reciprocating movement of said screen and attached to said screen frame, said cam surface being in contact with said cam follower and inclined such that said support surface pivots during the printing stroke in such a way that the snap-off and snap-on angles remain substantially constant.

3. The apparatus according to claim 1 further including:

two eccentrically mounted bars, one set upstream of the squeegee with respect to the movement of the web of material, and one set downstream of the squeegee;

means for adjusting the upstream bar to alter the angle at which web of material is fed to the squeegee when it is in contact with the web of the material;

means for adjusting the downstream bar to alter the angle at which the web of material leaves the squeegee, said support member supporting the two eccentrically mounted bars and being pivotally mounted about an axis in the vicinity of the line of contact between the squeegee and the mesh; and a cam surface attached to said reciprocating screen and a cam follower mounted on said support member, the cam and cam follower cooperating during the printing stroke to pivot the support surface so as to maintain the snap-off and snap-on angles substantially constant.

4. The printing apparatus according to claim 1 wherein said conveyor means comprises:

a pair of clamping bars on either side of said web material;

means for reciprocating the clamping bars through an elongated path with a forward stroke and a return stroke;

means for biasing the bars toward one another during the forward stroke to clamp the web of material between them and pull it through the printing station; and means for moving the clamping bars apart from one another during the return stroke.

* * * * *